US010245856B2

(12) United States Patent
Miyashita et al.

(10) Patent No.: US 10,245,856 B2
(45) Date of Patent: Apr. 2, 2019

(54) PRINTING SUSPENSION CONTROL FOR A PRINTER HAVING MULTIPLE PRINTING MECHANISMS

(71) Applicant: Brother Kogyo Kabushiki Kaisha, Nagoya-shi, Aichi-ken (JP)

(72) Inventors: Tomoki Miyashita, Nagoya (JP); Junya Kawai, Kiyosu (JP); Naoto Ito, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/457,421

(22) Filed: Mar. 13, 2017

(65) Prior Publication Data

US 2017/0266998 A1 Sep. 21, 2017

(30) Foreign Application Priority Data

Mar. 15, 2016 (JP) ..... 2016-050776

(51) Int. Cl.
*B41J 3/54* (2006.01)
*B41J 11/66* (2006.01)

(52) U.S. Cl.
CPC ..... *B41J 11/663* (2013.01); *B41J 3/54* (2013.01)

(58) Field of Classification Search
USPC ..... 358/1.1–3.29, 1.11–1.18; 347/117–168, 347/181, 182
See application file for complete search history.

(56) References Cited

U.S. PATENT DOCUMENTS 6,906,813 B1 * 6/2005 Tuchitoi ..... G06F 3/1204 358/1.1
2011/0236105 A1 * 9/2011 Noguchi ..... B41J 3/60 400/76
2011/0236107 A1 * 9/2011 Sugiura ..... B41J 3/60 400/76
2014/0085670 A1 * 3/2014 Maehira ..... G06F 3/121 358/1.15
2016/0019442 A1 * 1/2016 Kobayashi ..... G06K 15/023 358/1.15
2016/0267816 A1 * 9/2016 Anderson ..... G09F 3/02

FOREIGN PATENT DOCUMENTS

JP 4100824 B2 6/2008
JP 5512629 B2 6/2014

* cited by examiner

*Primary Examiner* — Marcellus J Augustin
(74) *Attorney, Agent, or Firm* — Banner & Witcoff, Ltd.

(57) ABSTRACT

A printer having multiple printing mechanisms has a printing device configured to execute a printing process to repetitively print a character defined for a page with one of the multiple printing mechanisms, and a controller. The controller is configured to determine, while the printing device is executing a first printing process which is the printing process for one page with use of the first printing mechanism, whether a first instruction to suspend the first printing process is received, print a page which is being printed when the first instruction is received to an end, and suspend the first printing process thereafter when the first instruction is received, determine whether a second instruction to start a second printing process with use of a second printing mechanism is received after the first printing process is suspended, and execute the second printing process when the second instruction is received.

16 Claims, 13 Drawing Sheets

PRINTING SUSPENSION CONTROL FOR A PRINTER HAVING MULTIPLE PRINTING MECHANISMS

CROSS-REFERENCE TO RELATED APPLICATIONS

This application claims priority under 35 U.S.C. § 119 from Japanese Patent Application No. 2016-050776 filed on Mar. 15, 2016. The entire subject matter of the application is incorporated herein by reference.

BACKGROUND

Technical Field

The present disclosures relate a printer and a method of controlling a printer.

Related Art

There has been proposed a printer provided with multiple printing mechanisms. With such a printer, printing can be applied to multiple printing media using corresponding printing mechanisms, respectively. In such a printer, there could be a case where, when printing is being applied to a first printing medium using a first printing mechanism, an instruction to apply printing to a second printing medium is received. In such a case, due to restriction of power capacity, there could be a case where a second printing mechanism corresponding to the second printing medium cannot be used simultaneously with the first printing mechanism. If printing is to be applied to the second printing medium after application of printing to the first printing medium is completed, it would take time till completion of printing on the second printing medium.

There is known prior art disclosing a printer in which, during a printing operation to execute label printing to issue first type labels, an interruption label printing can be executed to issue second type labels. In such a conventional printer, when an interruption label issuing button is depressed during issuance of the first type labels, the printing operation to issue the first type labels is suspended, and issuance of the second type label is started. After issuance of the second type labels is completed, issuance of the first type labels can be resumed.

SUMMARY

In the printer having multiple printing mechanisms, when a first printing operation to print images on first printing sheets is being executed, if a print instruction to execute another printing operation (e.g., a second printing operation) using the same printing sheets (i.e., the first printing sheets) is received, it is possible to execute to suspend the first printing operation and execute the second printing operation. However, when the first printing operation to print images on the first printing sheets is being executed with use of a first printing mechanism, if a print instruction to execute the second printing operation to print images on second printing sheets with use of a second printing mechanism is received, it is impossible to assign a higher priority to the second printing operation than the first printing operation.

According to aspects of the disclosures, there is provided a printer having multiple printing mechanisms including a first printing mechanism and a second printing mechanism each configured to apply printing to a printing medium. The printer is provided with a printing device configured to execute a printing process to repetitively print a character defined for a page with one of the multiple printing mechanisms, and a controller. The controller is configured to determine, while the printing device is executing a first printing process which is the printing process for one page with use of the first printing mechanism, whether a first instruction to suspend the first printing process is received, when it is determined that the first instruction is received, print a page which is being printed when the first instruction is received to an end, and suspend the first printing process thereafter, determine whether a second instruction to start a second printing process with use of the second printing mechanism is received after the first printing process is suspended, and execute the second printing process with use of the second printing mechanism when it is determined that the second instruction is received.

BRIEF DESCRIPTION OF THE ACCOMPANYING DRAWINGS

DETAILED DESCRIPTION OF THE EMBODIMENT

<General Description of Printer>

Referring to FIGS. 1-4, a printer 1 according to an embodiment of the present disclosures will be described.

Figure 3:
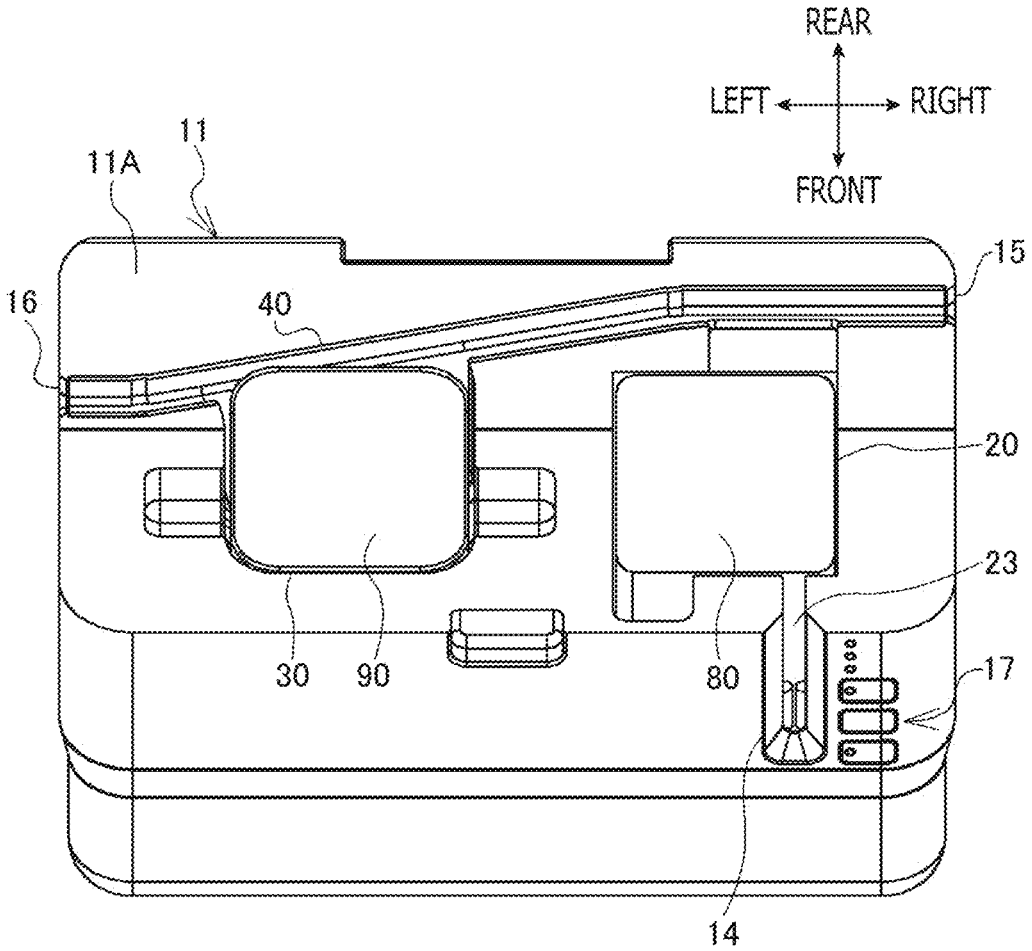
FIG. 3 is a perspective view, viewed from an upper front side, of a casing of the printer.
Figure 4:
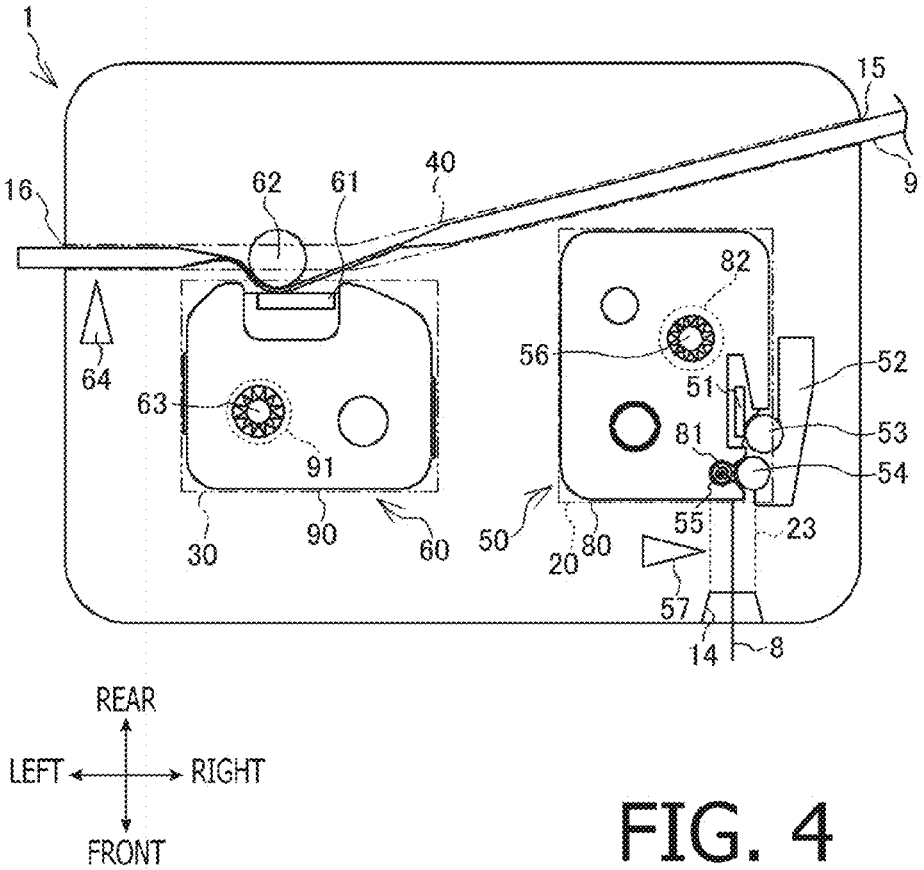
FIG. 4 is a plan view of the printer schematically showing an inner structure of the printer.

FIG. 3 schematically shows a tape cassette 80 and a ribbon cassette 90. FIG. 4 shows the printer 1 in which the tape cassette 80, the ribbon cassette 90 and a tube 9 are mounted on a tape mounting section 20, a ribbon mounting section 30 and a tube mounting section 40, respectively. In the following description, up, down, lower right, upper left, upper right and lower left directions of FIG. 1 will be referred to as up, down, right, left, rear and front sides of the printer 1, respectively.

<Configuration of Printer>

Figure 1:
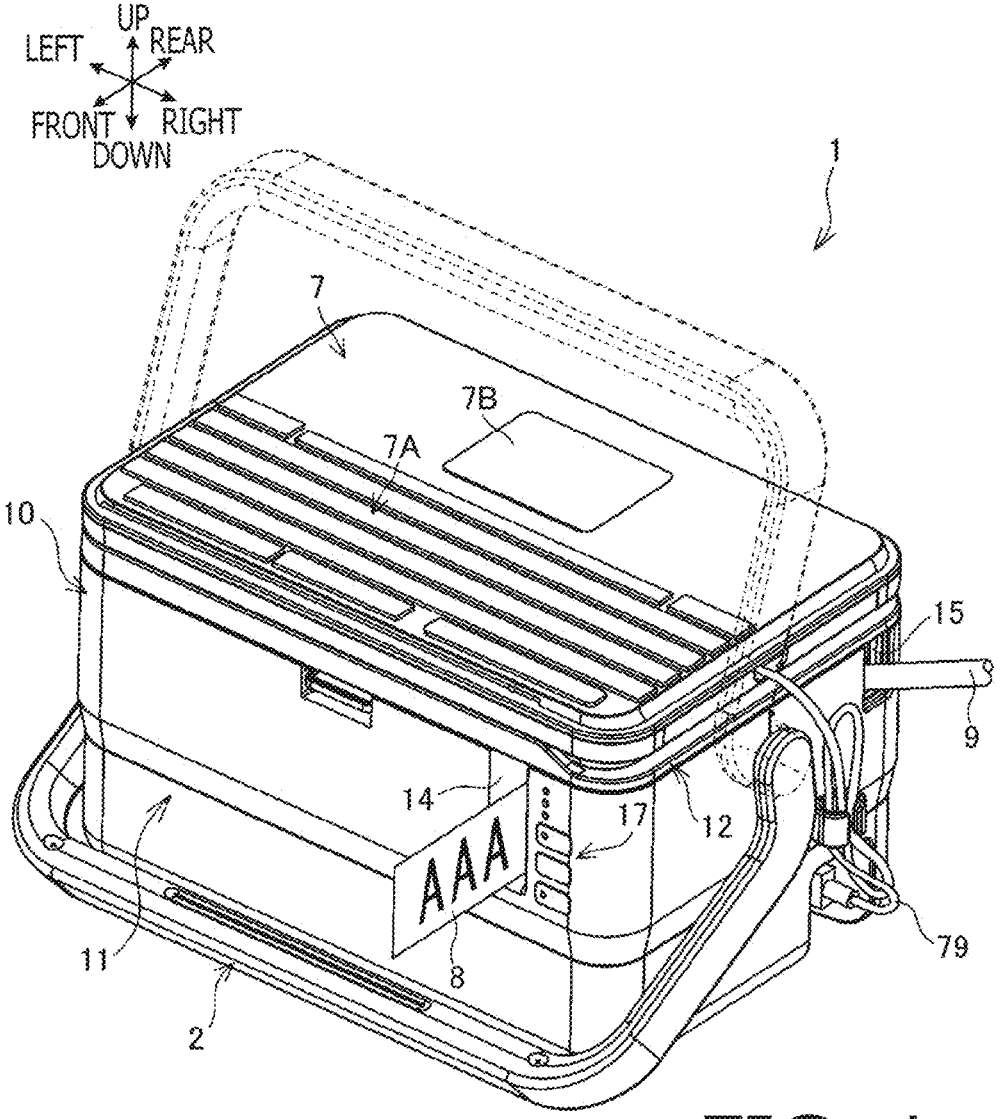
FIG. 1 is a perspective view, viewed from an upper left side, of a printer according to an illustrative embodiment of the disclosures.
Figure 2:
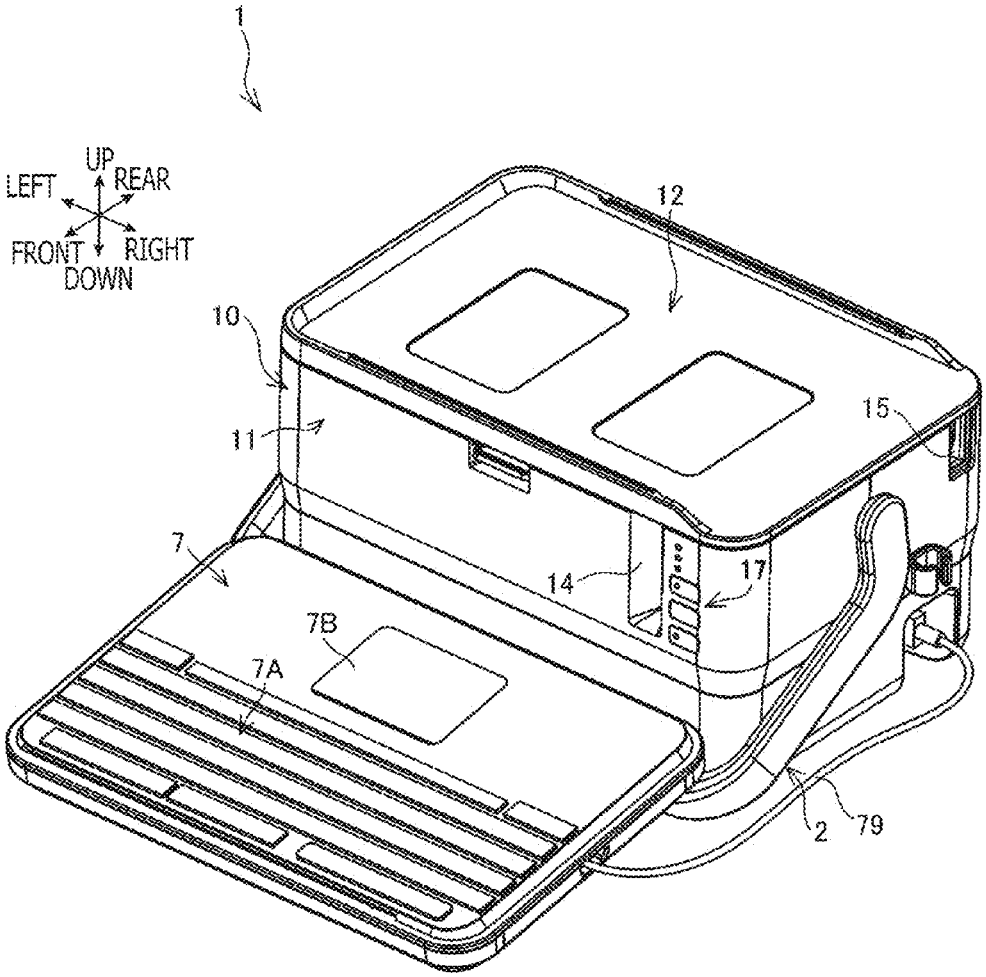
FIG. 2 is a perspective view, viewed from an upper right side, of the printer according to the illustrative embodiment in which a keyboard is leaned on a handle.

As shown in FIG. 1, the printer 1 is configured to print images on a belt-like medium (i.e., a tape 8) and a tubular medium (i.e., a tube 9) with used of two printing mechanisms, respectively. As shown in FIG. 2, the printer 1 has a main body 10 including a casing 11 and a cover 12. The casing 11 is a rectangular parallelepiped box-like member extending in a right-left direction. The cover 12 is a plate-like member arranged on an upper side of the casing 11. An upper surface of the cover 12 is formed to be a substantially planar face. A rear end part of the cover 12 is rotatably supported at an upper-rear end part of the casing 11. When the cover 12 is closed with respect to the casing 11, the cover 12 covers a mounting face 11A (see FIG. 3). When the cover 12 is opened with respect to the casing 11, the mounting face 11A is exposed upward (see FIG. 3). A handle 2 is rotatably supported on right and left side faces of the casing 11. The handle 2 is a member which is gripped by a user when the user carries about the printer 1.

As shown in FIG. 1, on an upper face of the cover 12, a keyboard 7 is detachably attached. The keyboard 7 has a box-like shape having a substantially rectangular plan view and extending in the right-left direction. The keyboard 7 is provided with multiple keys 7A to be operated by a user, and a display 7B configured display information. According to the illustrative embodiment, the display 7B is an LCD (liquid crystal display). The user can edit letters, symbols, graphic symbols and the like to be printed on the printing medium by operating the multiple keys 7A with viewing an image displayed on the display 7B. As shown in FIG. 2, the keyboard 7 can be used as it is detached from the cover 12 and is leaned on the handle 2. On a right end of the keyboard 7, a USB (universal serial bus) cable 79, which extends from a right end of the casing 11 is connected.

On side faces of the main body 10, a tape discharge opening 14, a tube insertion opening 15, a tube discharge opening 16 (see FIG. 3) and an operation section 17. The tape discharge opening 14 is an opening formed on a front face of the main body 10, and the tape 8 is discharge outside through the tape discharge opening 14. The tube insertion opening 15 is formed on a right face of the main body 10, and is configured to guide the tube 9 inside the main body 10. The tube discharge opening 16 is formed on a left face of the main body 10, and the tube 9 is discharge outside through the tube discharge opening 16. The operation section 17 includes multiple LED's (light emitting diodes) configured to indicate an operation state of the printer 1 and a power button.

As shown in FIG. 3, a tape mounting section 20, a ribbon mounting section 30, a tube mounting section 40 are defined on the mounting face 11A. The tape mounting section 20 is a concave section opening upward, and a tape cassette 80 can be detachably attached thereto. According to the illustrative embodiment, the tape mounting section 20 is defined on a right side of the mounting face 11A. In a state where the cover 12 is opened (see FIG. 1), the user can attach the tape cassette 80 to the tape mounting section 20 from the above, and can detach the same from the tape cassette 80 from the tape mounting section 20. A passage 23 is a groove continuously extending frontward from a right-front part of the tape mounting section 20. A front end of the passage 23 is connected to the tape discharge opening 14.

The ribbon mounting section 30 is a concave section opening upward, and the ribbon cassette 90 can be detachably attached to the ribbon mounting section 30. According to the illustrative embodiment, the ribbon mounting section 30 is defined on a left part of the mounting face 11A. The user can detach the ribbon cassette 90 from the ribbon mounting section 30, or attach the ribbon cassette 90 to the ribbon mounting section 30 from the above, with the cover 12 being opened.

The tube mounting section 40 is a section to which the tube 9 is detachably attached (see FIG. 1). The tube mounting section 40 a groove opening upward and extending from the tube insertion opening 15 to the tube discharge opening 16. The tube mounting section 40 passes behind the tape mounting section 20 and the ribbon mounting section 30, and communicates with a rear end of the ribbon mounting section 30. The user can detach the tube 9 from the tube mounting section 40 or attach the tube 9 to the tube mounting section 40 from the above with the cover 12 being opened. The tube 9 is to be attached to the tube mounting section 40 such that the tube 9 extends from the tube insertion opening 15 to the tube discharge opening 16.

As shown in FIG. 4, the tape cassette 80 is a box-like member accommodating an unused tape 8, an unused ink ribbon (not shown in FIG. 4), a tape driving roller 81, a ribbon winding spool 82 and the like. The tape driving roller 81 is a roller to draw the tape 8 from the tape cassette 80. The ribbon winding spool 82 is a spool configured to wind the ink ribbon inside the tape cassette 80.

The tape mounting section 20 is provided with a print head 51, a tape driving shaft 55 and a ribbon winding shaft 56. According to the illustrative embodiment, the print head 51 is a thermal head having multiple printing elements, which are aligned in a direction perpendicular to a conveying direction of the tape 8 to perform a printing operation on a line basis. The tape driving shaft 55 is a shaft configured to rotate the tape driving roller 81. The ribbon winding shaft 56 is a shaft configured to rotate the ribbon winding spool 82. On the right side of the tape mounting section 20, a platen holder 52 rotatably supporting the platen roller 53 and a movable conveying roller 54 is provided. The platen roller 53 is a roller which is rotatable relative to the print head 51. The movable conveying roller 54 is a roller which is rotatable relative to the tape driving shaft 55.

When the cover 12 (see FIG. 1) is opened, the platen holder 52 is moved to a retracted position, and the platen roller 53 and the movable conveying roller 54 are arranged outside the tape mounting section 20. When the user attaches the tape cassette 80 at the tape mounting section 20, the tape driving shaft 55 and the ribbon winding shaft 56 are inserted in the tape driving roller 81 and the ribbon winding spool 82, respectively.

Thereafter, when the cover 12 is closed, the platen holder 52 moves to an operating position, and the platen roller 53 and the movable conveying roller 54 are arranged inside the tape mounting section 20. At this stage, the platen roller 53 urges the tape 8 of the tape cassette 80 and the ink ribbon toward the print head 51 in an overlapped state. The movable conveying roller 54, in association with the tape driving roller 81, sandwiches the tape 8 of the tape cassette 80 and the ink ribbon therebetween. As a result, the printer 1 is in condition for executing a printing operation with use of tape 8 of the tape cassette 80. In the following description, the print head 51, the platen roller 53, the movable conveying roller 54, the tape driving shaft 55 and the ribbon winding shaft 56 are collectively referred to as a tape printing mechanism 50.

Behind the tape discharge opening 14, and on a downstream side, in the conveying direction of the tape 8, with respect to the tap printing mechanism 50, a cutter 57 configured to cut the tape 8 on the passage 23 in a direction of the thickness of the tape 8 is provided. The cutter 57 is configured to perform half cut to form a slit by cutting a part of layers of the tape 8 (e.g., only a release paper of the tape 8), and full cut to cut all the layers of the tape 8 (e.g., the release paper and mount of the tape 8) so that a part of the tape 8 is cut off.

The ribbon cassette 90 is a box-like member accommodating an unused ink ribbon, a ribbon winding spool 91 and the like. On the ribbon mounting section 30, a print head 61, a movable conveying roller 62 and a ribbon winding shaft 63 are provided. According to the illustrative embodiment, the print head 61 is a thermal head having multiple printing elements, which are aligned in a direction perpendicular to a conveying direction of the tube 9 to perform a printing operation on a line basis. The movable conveying roller 62 is a roller configured to rotate relative to the print head 61. The ribbon winding shaft 63 is a shaft configured to rotate the ribbon winding spool 91.

When the cover 12 (FIG. 1) is opened, the movable conveying roller 62 is arranged on a rear side of the tube mounting section 40, and spaced from the print head 61. When the user attaches the ribbon cassette 90 to the ribbon mounting section 30, the ribbon winding shaft 63 is inserted in the ribbon winding spool 91. Thereafter, the user attaches the tube 9 to the tube mounting section 40. Next, when the cover 12 is closed, the movable conveying roller 62 is arranged inside the tube mounting section 40, and approaches the print head 61. At this stage, the movable conveying roller 62 urges the tube 9 attached to the tube mounting section 40 and the ink ribbon of the ribbon cassette 90 toward the print head 61 in an overlapped state. As a result, the printer 1 is in a condition to perform printing on the tube 9 with user of the ribbon cassette 90. In the following description, the print head 61, the movable conveying roller 62 and the ribbon winding shaft 63 will be collectively referred to as a tube printing mechanism 60.

On the right side of the tube discharge opening 16, and on the downstream side, in the conveying direction of the tube 9, with respect to the tube printing mechanism 60, a cutter 64 configured to cut the tube 9 in the tube mounting section 40 in the radial direction is provided. The cutter 64 is capable of perform half-cut to partially cut the tube 9 in the radial direction to form a slit on the tube 9, and full-cut to fully cut the tube 9 in the radial direction to cut apart a part of the tube 9.

<General Description on Printing Function (Repetitive Printing)>

The printer 1 has a function of repetitive printing. The repetitive printing function is a function to print letters, letter string, numbers, symbols, graphic symbols, and illustrations and the like (hereinafter, collectively referred to as characters) on the tape 8 or tube 9 repeatedly in accordance with a specific rule. An example of the repetitive printing is to repeatedly print a particular letter string on the tape 8 or tube 9. For example, when the particular letter string is "brother", on the tape 8 or the tube 9, a letter string "brother" is repeatedly printed (e.g., brother brother brother brother . . . ). Another example of the repetitive printing is to repeatedly print a particular letter string with changing a part of the particular letter string. An example of such a repetitive printing is to print "M D, 2017" with changing the date (i.e., "D" representing a day, and "M" representing a month) sequentially. In such a case, on the tape 8 or the tube 9, "Jan. 1, 2017, Jan. 2, 2017, . . . Feb. 1, 2017, Feb. 2, 2017, . . . Dec. 31, 2017" will be printed with changing the "M" and "D" in the ascending order.

In the following description, a unit of the medium (i.e., the tape 8 or the tube 9) delimited by the characters subject to the repetitive printing will be referred to as a "page" hereinafter. In the above examples, a unit of the tape 8 or the tube 9 where the "brother" or the "M D, 2017" is printed corresponds to the page. That is, in the repetitive printing, the characters subject to the repetitive printing (i.e., sectioned per page) is printed on the tape 8 or the tube 9 on a page basis.

<Electrical Configuration of Printer>

Figure 5:
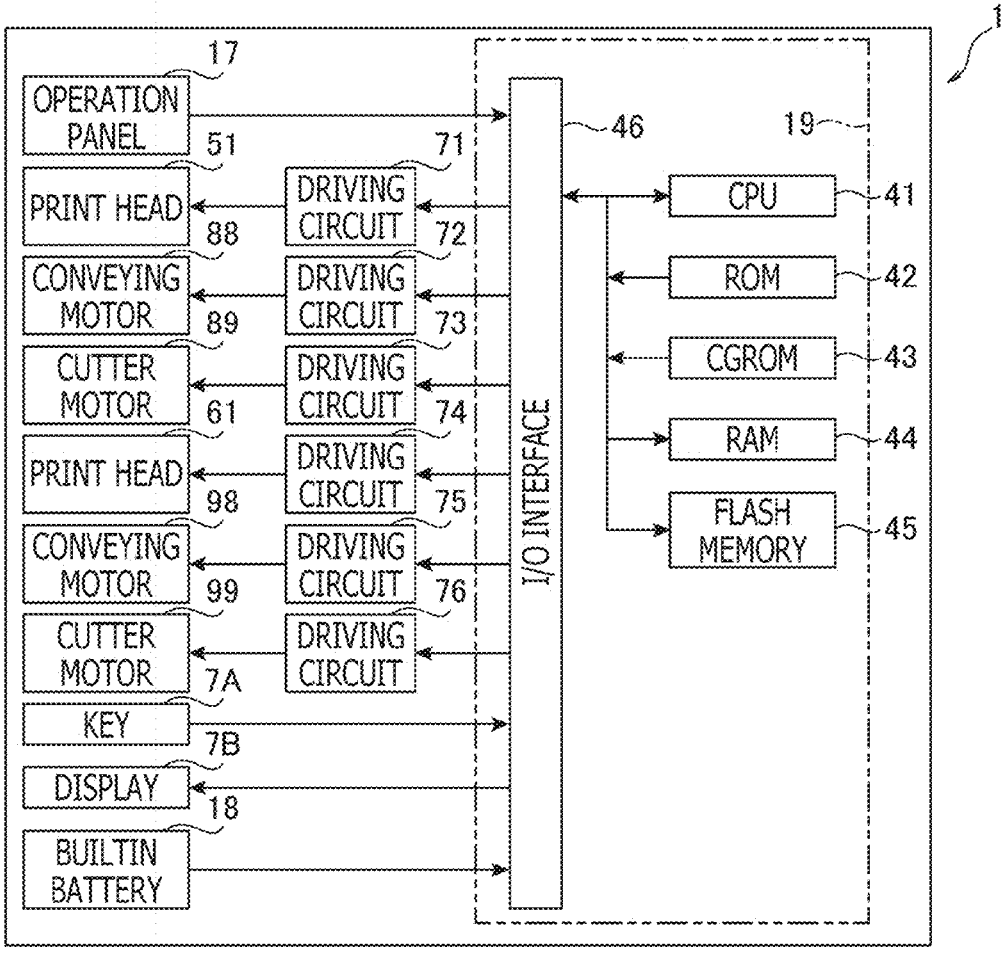
FIG. 5 is a block diagram showing an electrical configuration of the printer.

An electrical configuration of the printer 1 will be described referring to FIG. 5. The printer 1 has a control circuit board 19. The control circuit board 19 includes a CPU (central processing unit) 41, a ROM (read only memory) 42, a CGROM (Character Generator ROM) 43, a RAM (random access memory) 44, a flash memory 45, an I/O (input/output) interface 46 and the like, which are interconnected through a data bus. The ROM 42 stores programs which are to be executed by the CPU 41 to control the printer 1. The CGROM 43 stored print dot pattern data which is used to print the characters. The character is at least one of a letter, a letter string, a number, a symbol, a graphic symbol, an illustration and the like. The RAM 44 temporarily stores data. The flash memory 45 stores repetition setting information, general setting information, and resume information. The repetition setting information is information representing a setting of the repetitive printing. The repetition setting information includes, at least, a total number of pages, and a cutting method (i.e., half-cut or full-cut) for each page. The general setting information is information representing general setting information regarding printing. The general setting information includes, at least, font and size of each character.

The I/O interface 46 is provided with an operation section 17, multiple keys 7A, display 7B, a built-in battery 18, driving circuits 71, 72, 73, 74, 75 and 76. When the printer 1 is connected to an external power source (not shown), the built-in battery 18 is charged by the power supplied by the external battery 18. When the printer 1 is not connected to the external power source, the built-in battery 18 supplies the charged power to the printer 1.

The driving circuit 71 is an electronic circuit for driving the print head 51. The driving circuit 72 is an electronic circuit to drive a conveying motor 88 which rotates the tape driving shaft 55 and the ribbon winding shaft 56. The driving circuit 73 is an electronic circuit for driving a cutting motor 89 which actuates a cutter 57. The driving circuit 74 is an electronic circuit for driving the print head 61. The driving circuit 75 is an electronic circuit for driving a conveying motor 98 which rotates the movable conveying roller 62 and the ribbon winding shaft 63. The driving circuit 76 is an electronic circuit for driving a cutting motor 99 which actuates a cutter 64.

It is noted that, according to the illustrative embodiment, the printer 1 is configured such that the print head 51 and the conveying motor 88 cannot be driven simultaneously with the print head 61 and the conveying motor 98. The reason is that an electrical current necessary to drive the print head 51 and the conveying motor 88, and an electrical current necessary to drive the print head 61 and the conveying motor 98 cannot be simultaneously supplied to the printer 1 from the built-in battery 18 or the external power source. It is noted that the print head 51 and the conveying motor 88 correspond to a configuration to drive the tape printing mechanism 50, while the print head 61 and the conveying motor 98 correspond to a configuration to drive the tube printing mechanism 60. That is, the printer 1 cannot simultaneously execute a printing process on the tape 8 (hereinafter, referred to as a tape printing process) with the tape printing mechanism 50, and a printing process on the tube 9 (hereinafter, referred to as a tube printing process) with the tube printing mechanism 60.

Thus, the printer 1 executes, in a main process described later, the tape printing process and the tube printing process exclusively. Further, when executing one of the tape printing process and the tube printing process, when an operation to satisfy a particular condition, the printer 1 is capable of interrupting the currently executed printing process, and executing the other printing process. Further, when the other printing process is completed, and another operation to satisfy a particular condition is executed, the printer 1 can resume the initially executed and interrupted printing process.

<Main Process>

Hereinafter, referring to FIGS. 6-11, the main process will be described. When a power button of the operation section 17 is depressed, the CPU 41 executes a program stored in the ROM 42, thereby starting the main process. In the following description, a case where the repetitive printing to repeatedly print the common characters is executed by the printer 1 will be described.

When the main process is executed, the CPU 41 refers to flags (a power flag, a print flag, a suspend flag, and a display flag) stored in the RAM 44. The power flag indicates a state of the power of the printer 1. Specifically, when the printer 1 is powered on, the power flag is set to one, while, when the printer 1 is powered off, the power flag is set to zero.

The print flag indicates a printing state of the printer 1. During execution of the tape printing process, the print flag is set to one. During execution of the tube printing process, the print flag is set to two. When the printer 1 is not executing the tape printing process or the tube printing process, the print flag is set to zero.

The suspend flag indicates whether the printing process is temporarily suspended or not. Specifically, when the tape printing process is suspended, the suspend flag is set to one. Then the tube printing process is suspended, the suspend flag is set to two. When neither the tape printing process nor the tube printing process is suspended, the suspend flag is set to zero.

Figure 13:
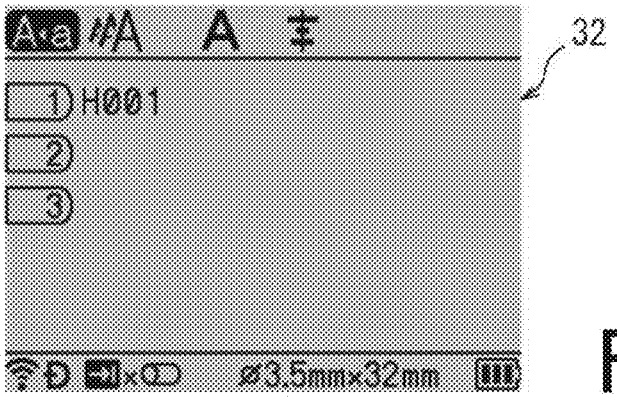
FIG. 13 shows a tube edit screen according the illustrative embodiment.
Figure 14:
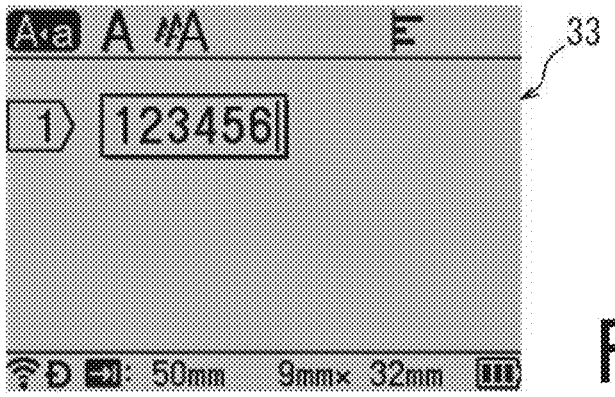
FIG. 14 shows a tape edit screen according the illustrative embodiment.

The display flag indicates a screen to be displayed on the display 7B of the keyboard 7. When a home screen 31 (see FIG. 12) is to be displayed on the display 7B, the display flag is set to one. When an edit screen, on which a character to be printed in the tube printing process can be edited, is displayed, the display flag is set to two. Such a screen will be referred to as a tube edit screen 32 hereinafter (see FIG. 13). When an edit screen, on which a character to be printed in the tape printing process can be edited, is displayed, the display flag is set to three. Such a screen will be referred to as a tape edit screen 32 hereinafter (see FIG. 14). When a not-shown setting screen is to be displayed on the display 7B, the display flag is set to four.

Figure 6:
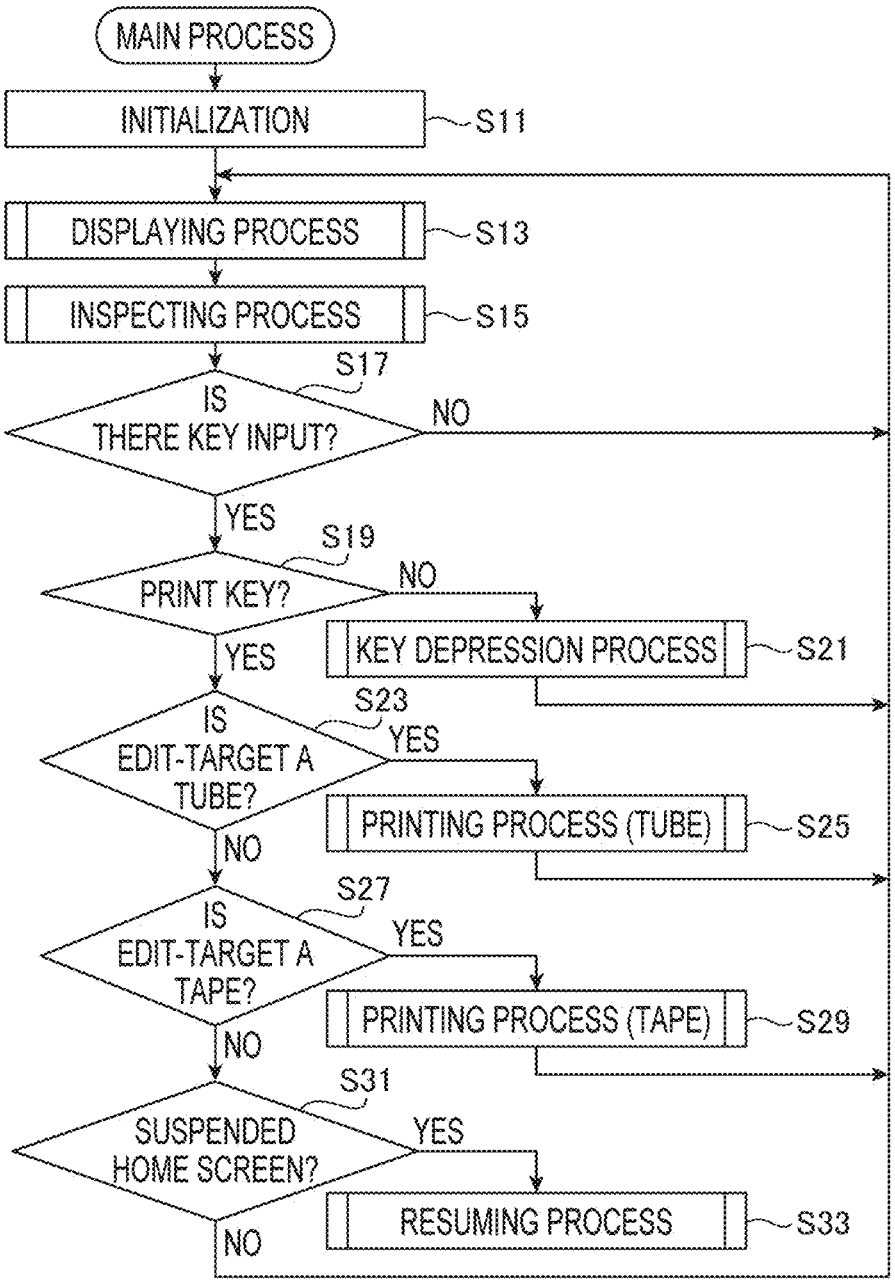
FIG. 6 is a flowchart illustrating a main process according to the illustrative embodiment.

As shown in FIG. 6, the CPU 41 initially executes an initializing process (S11). In the initialization process, a standby process by the driving circuits 71-76, determination of a type of the tape cassette 80 attached to the tape mounting section 20, and determination of a type of the ribbon cassette 90 attached to the ribbon mounting section 30. Further, the CPU 41 initializes the values of the flags stored in the RAM 44. Specifically, the CPU 41 set "one" to the power flag and the display flag, and set "zero" to the print flag and the suspend flag. The CPU 41 executes a displaying process (FIG. 7).

Figure 7:
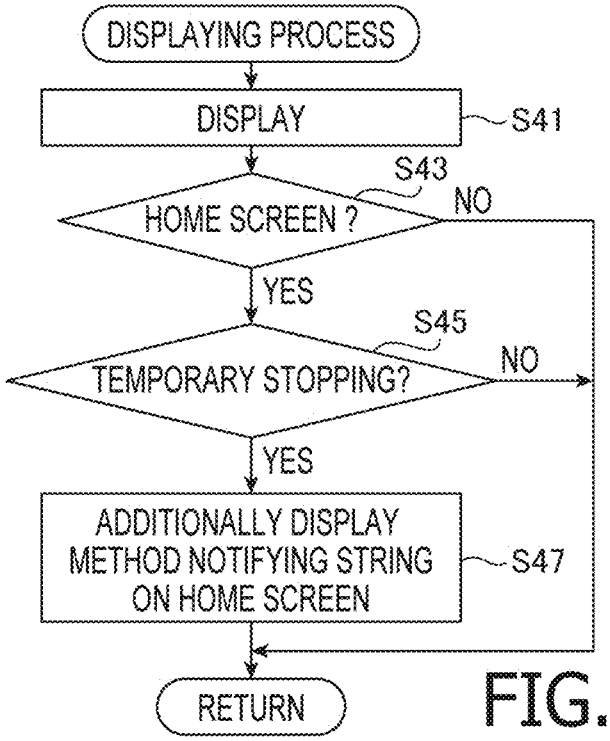
FIG. 7 is a flowchart illustrating a displaying process according to the illustrative embodiment.

Referring to FIG. 7, the displaying process will be described. CPU 41 displays a screen corresponding to the vale set to the display flag on the display 7B (S41). It is noted that display flag is set to one in the initializing process (S11) immediately after the main process is started. Therefore, immediately after the main process is started, in S41, the home screen 31 is displayed on the display 7B.

Figure 12:
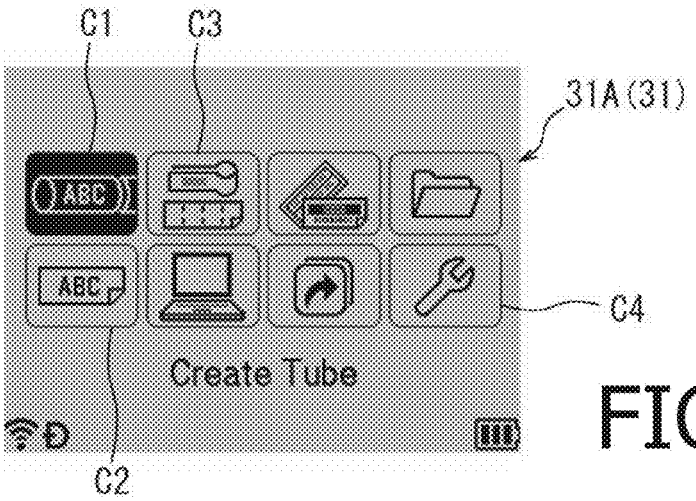
FIG. 12 shows a home screen according the illustrative embodiment.

As shown FIG. 12, on the home screen 31A, multiple icons indicating contents of various instructions to the printer 1 are displayed. Among the multiple icons, an upper left icon C1 is to be selected when a character to be printed in the tube printing process is edited. A lower left icon C2 is to be selected when a character to be printed in the tape printing process is edited. An icon C3 on the right side of the icon C1 is to be selected when the repetition setting information is set. A lower right icon C4 is to be selected when the general setting information is set.

It is noted that one of the multiple icons (e.g., icon C1 in FIG. 12) is inversely displayed. The icon inversely displayed can be changed as arrow keys among the multiple keys 7A are depressed. When a determination key of the multiple keys 7A is depressed with the home screen 31A being displayed, the inversely displayed icon (e.g., C1 in FIG. 12) is selected.

As shown in FIG. 7, the CPU 41 determines whether the home screen 31 is displayed on the display 7B (S43). When it is determined that the home screen 31 is displayed on the display 7B (S43: YES), the CPU 41 determines whether the tape printing process or the tube printing process is suspended based on the suspend flag (S45). It is noted that the tape printing process and the tube printing process are suspended when the stop key of the multiple keys 7A is depressed during execution of the printing process (S87 of FIG. 10). It is noted that, immediately after the main process is started, the suspend flag is set to zero in the initialization process (S11). Thus, the CPU 41 determines that neither the tape printing process nor the tube printing process is suspended (S45: NO), when it is immediately after start of the main process. In this case, the CPU 41 terminates the displaying process, and returns the control to the main process (see FIG. 6).

Figure 8:
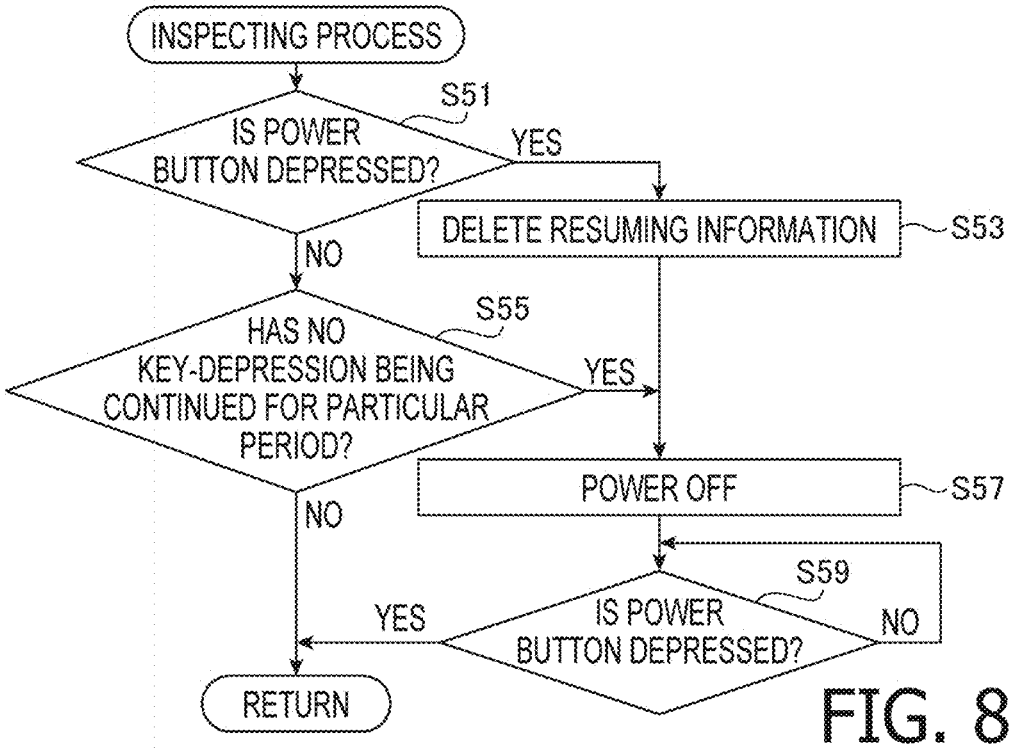
FIG. 8 is a flowchart illustrating an inspecting process according to the illustrative embodiment.

As shown in FIG. 6, after completion of the displaying process (S13), the CPU 41 executes the inspecting process (see FIG. 8) (S15). Referring to FIG. 8, the inspecting process will be described. In S51, the CPU 41 determines whether the power button of the operation section 17 is depressed. It is noted that depression of the power button in a state where the power flag is set to one corresponds an operation to power off the printer 1. When it is determined that the power button of the operation section 17 is not depressed (S51: NO), the CPU 41 forwards control to S55.

The CPU 41 determines whether a state where none of the multiple keys 7A of the keyboard 7 has been depressed continues for a particular period (S55). When it is determined that the state that none of the multiple keys 7A of the keyboard 7 has been depressed does not continue for the particular period (S55: NO), the CPU 41 terminates the inspecting process, and forwards control to the main process (see FIG. 6). When it is determined that the state that none of the multiple keys 7A of the keyboard 7 has been depressed continues for the particular period (S55: YES), the CPU 41 set the power flag to zero and forwards control to S57. In S57, the CPU 41 brings the printer 1 in a state that all of the operations thereof are stopped. In the following description, to bring the printer 1 in the state that all of the operations thereof are stopped will be referred to as "powering off of the printer 1". That is, the above-described function to bring the printer 1 in the state that all of the operations thereof are stopped when none of the keys 7A of the keyboard 7 has been depressed for the particular period corresponds to a so-called auto power-off function.

In S59, the CPU 41 determines whether the power button is depressed. It is noted that depression of the power button when the power flag is set to zero corresponds to an operation to power on the printer 1. When it is determined that the power button is not depressed (S59: NO), the CPU 41 returns control to S59. Then, the CPU 41 continuously monitors depression of the power button. When it is determined that the power button is depressed (S59: YES), the CPU 41 sets the power flag to one, and brings the printer 1 in a state that all of its operations can be performed. In the following description, to bring the printer 1 in a state that all of its operations can be performed will be referred to as powering on of the printer 1. When the printer 1 is powered on, the CPU 41 terminates the inspecting process, and returns control to the main process (see FIG. 6).

As shown in FIG. 6, after termination of the inspecting process (S15), the CPU 41 determines whether one of the multiple keys 7A of the keyboard 7 is depressed (S17). When it is determined that none of the multiple keys 7A is depressed (S17: NO), the CPU 41 returns the process to S13. The CPU 41 repeatedly executes the displaying process (S13) and the inspecting process (S15). When it is determined that one of the multiple keys 7A is depressed (S17: YES), the CPU 41 forwards the process to S19.

In S19, the CPU 41 determines whether the print key of the multiple keys 7A is depressed (S19). When it is determined that one of the multiple keys 7A other than the print key is depressed (S19: NO), the CPU 41 executes the key depression process (see FIG. 9) in S21.

Figure 9:
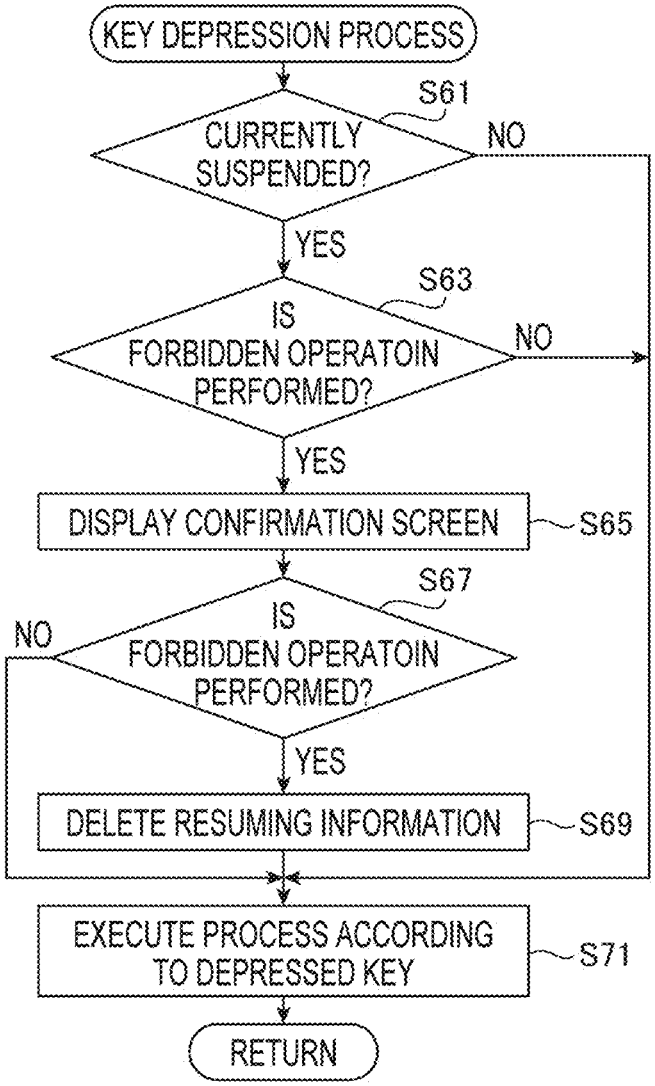
FIG. 9 is a flowchart illustrating a key depression process according to the illustrative embodiment.

Referring to FIG. 9, the key depression process will be described. In S61, the CPU 41 determines whether the tape printing process or the tube printing process is suspended based on the suspend flag. When the suspend flag is set to zero, the CPU 41 determines that neither the tape printing process nor the tube printing process is suspended (S61: NO). In this case, the CPU 41 forwards the process to S71. In S71, the CPU 41 executes a process corresponding to the depressed key. Thereafter, the CPU 41 terminates the key depression process, and returns the process to the main process (see FIG. 6).

The process corresponding to the depressed key in S71 will be described. As an example, it is assumed that the home screen 31A on which the icon C1 is inversely displayed, as shown in FIG. 12, is displayed and the determination key of the multiple keys 7A is depressed (S17: YES, S19: NO, S61: NO). In such a case, the CPU 41 displays the tube edit screen 32 (see FIG. 13) on the display 7B in S71.

Then, the CPU 41 set value "two" which indicates that the tube edit screen 32 is displayed on the display 7B to the display flag (S71). In this case, when the CPU 41 executes the displaying process (see FIG. 7) after completion of the key depression process (see FIG. 9), the CPU 41 continuously displays, in S41, the tube edit screen 32 on the display 7B based on the value "two" which is set to the display flag.

When a character key "H001" of the multiple keys 7A is depressed with the tube edit screen 32 being displayed on the display 7B (S17: YES, S19: NO, S61: NO), the CPU 41 displays a character corresponding to the depressed character key on the tube edit screen 32 (S71). It is noted that the character displayed on the tube edit screen 32 corresponds to a character to be printed on one page of the tube 9 in the repetitive printing.

It is noted that the process executed in S71 need not be limited to one executed in the above-described embodiment. For example, when the determination key is depressed when the home screen 31, on which icon C2 is inversely displayed, is displayed on the display 7B, the CPU 41 displays the tape edit screen 33 (see FIG. 14) on which the character to be printed in the tape printing process is displayed on the display 7B in S71. In such a case, the CPU 41 set value "three" representing that the tape edit screen 33 is displayed on the display 7B to the display flag (S71). Further, when a character key of the multiple keys 7A is depressed with the tape edit screen 33 being displayed on the display 7B (S17: YES, S19: NO, S61: NO), the CPU 41 displays a character corresponding to the depressed character key on the tape edit screen 33 (S71). It is noted that the character displayed on the tape edit screen 33 corresponds to a character to be printed on one page of the tape 8 in the repetitive printing.

If icon C3 or C4 is inversely displayed on the home screen 31, and the determination key is depressed, the CPU 41 displays a setting screen through which the repetition setting information and the general setting information can be input on the display 7B (S71). Further, in such a case, the CPU 41 set value four, which represents that a setting screen is displayed on the display 7B, to the display flag (S71).

After completion of the key depression process (see FIG. 9), when the displaying process (see FIG. 7) is executed, the CPU 41 continuously displays the setting screen based on the value (i.e., four) set to the display flag (S41).

When one of the multiple keys 7A is depressed at this stage (S17: YES, S19: NO, S61: NO), the CPU 41 stores the repetition setting information or the general setting information in the flash memory 45 in accordance with the depressed key (S71).

In order to return the screen displayed on the display 7B from the setting screen to the home screen 31, the CPU 41 set the display flag to one (S71). Then, when the displaying process (FIG. 7) is executed after completion of the key depression process (FIG. 9), the CPU 41 displays the home screen 31 on the display 7B based on the set value (i.e., one) set to the display flag (S41).

As shown in FIG. 6, when it is determined that an operation to depress one of the multiple keys 7A is detected (S17: YES) and then, the print key is depressed (S19: YES), the CPU 41 forwards the process to S23. In S23, the CPU determines whether the tube edit screen 32 (FIG. 13) is currently displayed on the display 7B based on the display flag. When the display flag is set to two, the CPU 41 determines that the tube edit screen 32 is currently displayed on the display 7B (S23: YES). In this case, the CPU 41 executes the printing process (see FIG. 10), which will be described in detail later, in order to executes the tube printing process (S25).

When it is determined that the tube edit screen 32 (see FIG. 13) is not displayed on the display 7B (S23: NO), the CPU 41 determines whether the tape edit screen 33 (see FIG. 14) is being displayed on the display 7B based on the display flag (S27). When the display flag is set to "three", the CPU 41 determines that the tape edit screen 33 is being displayed (S27: YES). In this case, the CPU 41 executes the printing process (see FIG. 10), which will be described later, in order to execute the tape printing process (S29).

Figure 10:
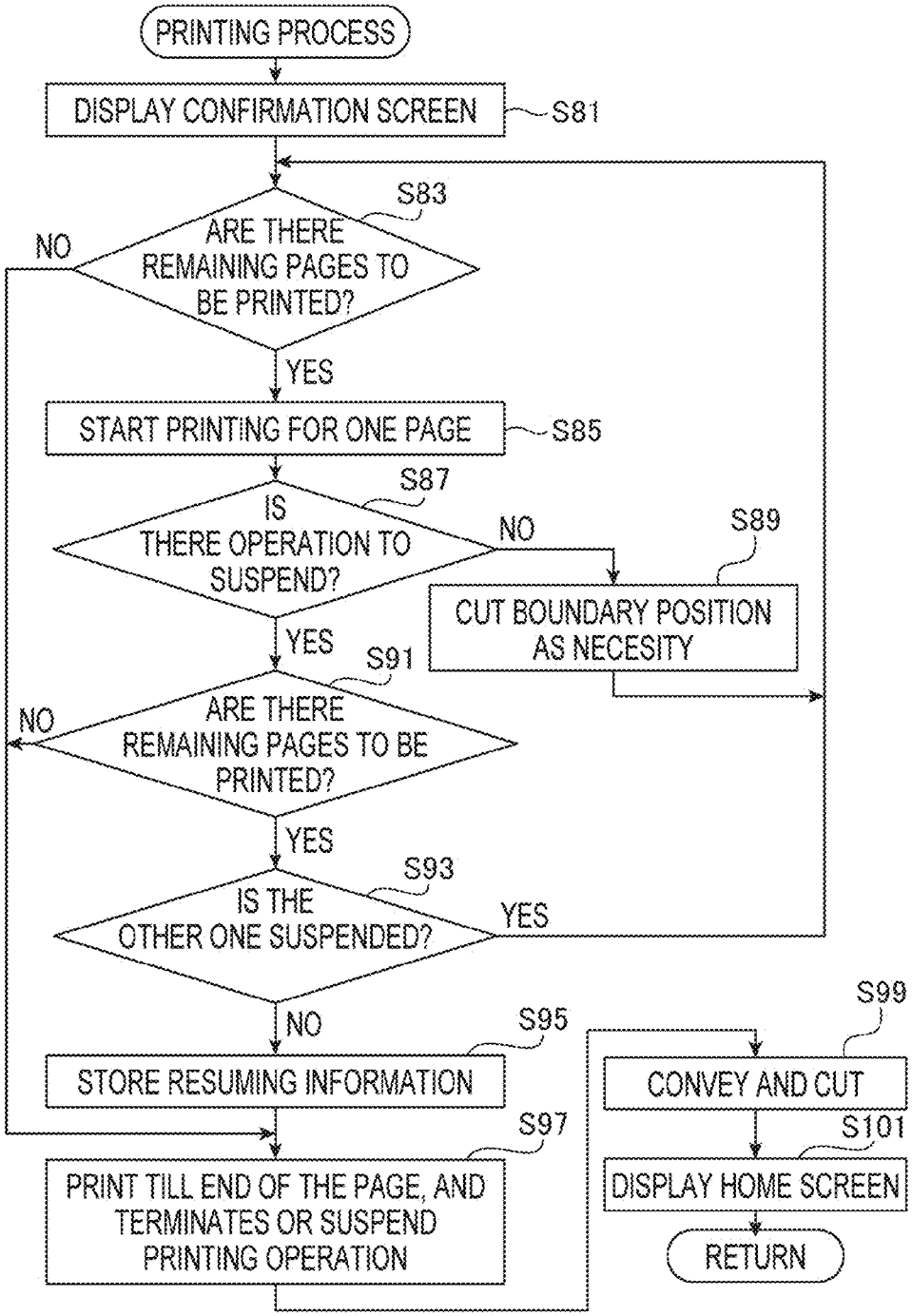
FIG. 10 is a flowchart illustrating a printing process according to the illustrative embodiment.

Referring to FIG. 10, the printing process will be described. It is noted that the actual process when the tube printing process is executed and the actual process when the tape printing process is executed are substantially the same. Therefore, in the following description, a case where the tube printing process is executed (S25) in accordance with the printing process will be described. Thus, in the following description, a case where the tube printing process is executed (S25) based on the printing process will be described in detail. On the other hand, a case where the tape printing process is executed (S29) based on the printing process will be simplified.

Figure 15:
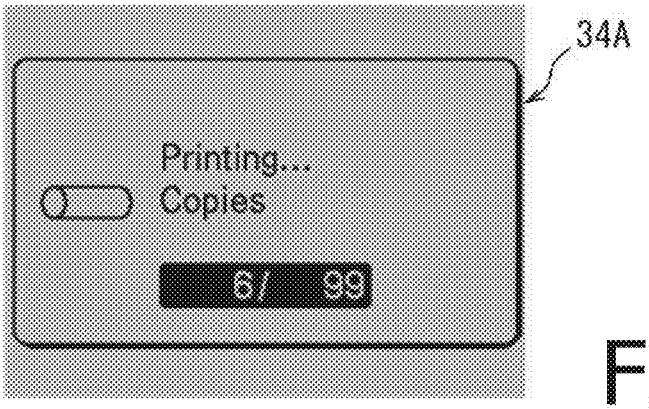
FIG. 15 shows a tube printing screen according the illustrative embodiment.

The CPU 41 displays the tube printing screen 34A (see FIG. 15) on the display 7B (S81). Then, based on the general setting information stored in the flash memory 45, the CPU 41 identifies the font and size of the character. The CPU 41 next identifies the total number of pages and the cutting method based on the repetition setting information stored in the flash memory 45. Then, the CPU 41 determines whether there are pages not having been printed (S83). When it is determined that there are pages not having been printed (S83: YES), the CPU 41 starts a process of printing the character for one page, which is displayed on the tube edit screen 32, on the tube 9 with the identified font and size (i.e., the tube printing process) (S85).

As shown in FIG. 4, in the tube printing process, the conveying motor 98 (see FIG. 5) rotates the movable conveying roller 62 and the ribbon winding shaft 63, thereby conveying the tube 9 in the tube mounting section 40 and rotating the ribbon winding spool 91, respectively. In association with rotation of the ribbon winding spool 91, unused ink ribbon inside the ribbon cassette 90 is extracted. The, thus extracted ink ribbon is conveyed to a position between the print head 61 and the movable conveying roller 62. The print head 61 operates synchronously with conveyance of the tube 9 and print the characters on the tube 9 using the ink ribbon. The used ink ribbon is wound by the ribbon winding spool 91. The printing tube 9 is conveyed on the downstream side with respect to the print head 61 by the movable conveying roller 62.

Figure 16:
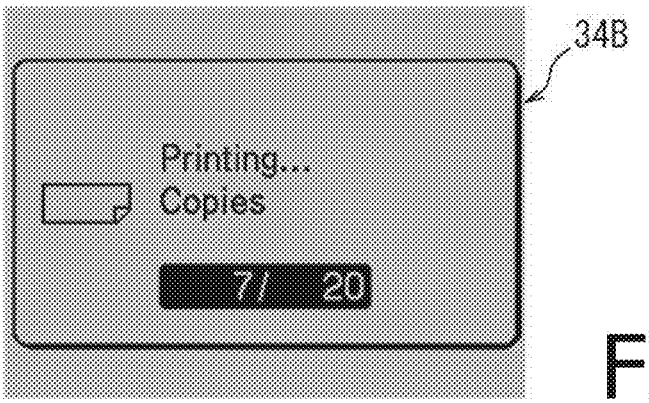
FIG. 16 shows a tape printing screen according the illustrative embodiment.

It is noted that, in the above-described process, when the printing on the tape 8 is executed according to the printing process (S29), the tape printing screen 34B (see FIG. 16) is displayed on the display 7B instead of the tube printing screen 34A in S81. When the process of S85 is executed, the conveying motor 88 (see FIG. 5) rotates the tape driving shaft 55 and the ribbon winding shaft 56, thereby rotating the tape driving roller 81 and the ribbon winding spool 82. In association with rotation of the tape driving roller 81, unused tape 8 inside the tape cassette 80 is extracted. Further, in association with rotation of the ribbon winding spool 82, unused ink ribbon inside the tape cassette 80 is extracted. The extracted film tape 85 and the ink ribbon 86 are conveyed to the position between the print head 51 and the platen roller 53. The print head 51 print characters on the tape 8 using the ink ribbon based on the image data sequentially retrieved out of the image buffer synchronously with conveyance of the tape 8. The used ink ribbon is wound by the ribbon winding spool 82, and the used tape 8 is conveyed toward the passage 23 by the movable conveying roller 54 and the tape driving roller 81.

As shown in FIG. 10, the CPU 41 determines whether the stop key of the multiple keys 7A is depressed (S87) before printing of the character for one page started in S83 is completed. When it is determined that the stop key is not depressed (S87: NO), the CPU 41 forwards the process to S89 upon completion of printing of the character for one page. In a process of conveying the tube 9 during the printing operation, when a boundary between adjacent pages is located at the position of the cutter 64, the CPU 41 causes the cuter 64 to execute a full-cut or a half-cut operation based on the cutting method indicated in the repetition setting information (S89). The tube 9 on which the character has been printed, and the full-cut or the half-cut has been applied is discharged from the tube discharge opening 16 (see FIG. 4). Then, the CPU 41 returns the process to S83.

When there remain pages to be printed (S83: YES), the CPU 41 repeats the tube printing process to print the character for one page, which is displayed on the tube edit screen 32, on the tube 9 (S85). When the process of S85 is repeated by the total number of pages indicated in the repetition setting information, the CPU 41 determines that there remain no pages to be printed (S83: NO). Then, the CPU 41 forwards the process to S97.

After the tube printing process is started in S85 and when it is determined that the stop key is depressed during printing of the character for one page is being executed (S87: YES), the CPU 41 forwards the process to S91 before completion of printing of the character for one page. It is noted that depression of the stop key corresponds to an operation to suspend the printing process which is being executed currently. In S91, the CPU 41 determines whether there remain pages, excluding the currently printed page, which have not been printed (S91). When it is determined that there remain no pages to be printed (S91: NO), that is, the stop key was depressed when the last page was being printed, the CPU 41 forwards the process to S97.

When it is determined that there remains a page to be printed other than the currently printed page (S91: YES), the CPU 41 forwards the process to S93. In S93, the CPU 41 determines whether the tape printing process is currently suspended based on the suspend flag. When the suspend flag is set to "one", the CPU 41 determines that the tape printing process is suspended (S93: YES). In such a case, the CPU 41 returns the process to S83. Therefore, even if the stop key is depressed during execution of the tube printing process, when the tape printing process is suspended, a suspending process (S97) of the tube printing process will not be executed.

When a value other than "one" is set to the suspend flag, the CPU 41 determines that the tape printing process is not suspended (S93: NO). In this case, the CPU 41 forwards the process to S95. The CPU 41 stores the resume information which includes at least the character for one page subject to the repetitive printing in the tube printing process, and a remaining number of pages representing the number of pages which have not been printing in the tube printing process in the flash memory 45 (S95). The CPU 41 set value "two" indicating that the tube printing process is suspended to the suspend flag (S95). Then, the CPU 41 forwards the process to S97.

When printing on the tape 8 is executed in the printing process (S29), the CPU 41 determines whether the tube printing process is suspended based on the suspend flag (S93). When the suspend flag is set to "two", the CPU 41 determines that the tube printing process is suspended (S93: YES). The CPU 41 returns the process to S83. When the suspend flag is set to a value other than "two", the CPU 41 determines that the tube printing process is not being suspended (S93: NO). The CPU 41 stores the resume information in the flash memory 45 (S95), and sets value "one" which represents that the tape printing process is suspended to the suspend flag.

When the printing of the total number of pages has been completed (S83: NO or S91: NO), after the character of the last page has been printed to the end, the CPU 41 terminates the tube printing process (S97). When the stop key is depressed in a state where the total number of pages have not been printed (S87: YES, S91: YES, S93: NO), the CPU 41 prints the character of the currently printing page to the end, and suspends the tube printing process (S97). The CPU 41 conveys the tube 9, by rotating the movable conveying roller 62, until a position on the upstream side (hereinafter, referred to as a cutout position) with respect to the printed part of one-page character which was printed immediately before the end or suspension of printing coincides with the position of the cutter 64. Thereafter, the CPU 41 apply the full-cut to the tape 9 at the cutout position with the cutter 64 (S96), thereby the CPU 41 cutting out the character-printed portion of the tube 9.

In the above process, there could be a case where a character-printer portion of the tube 9 which was printed before the tube printing process was completed or suspended in S97 remains between the print head 61 (see FIG. 4) and the cutter 64 (see FIG. 4) after completion or suspension of the tube printing process. In such a case, the CPU 41 rotates the movable conveying roller 62 to convey the tube 9, and controls the cutter 64 to cut the tube 9 (i.e., full-cut or half-cut) at a timing where each of boundaries between remaining pages is located at the position of the cutter 64 (S99). According to the above configuration, the tube 9 remaining between the print head 61 to the cutter 64 is cut on page basis and discharged out of the tube discharge opening 16. Finally, the CPU 41 applies the full-cut to the cutout position of the tube 9 (S99).

In S101, the CPU 41 switches the tube printing screen 34A (FIG. 15) displayed on the display 7B to the home screen 31A (FIG. 12). Then, the CPU 41 set the display flag to "one". Thereafter, the CPU 41 terminates the printing process, and returns the process to the main process (see FIG. 6). As shown in FIG. 6, after completion of the printing process (S25, S29), the CPU 41 returns the process to S13.

In S13, the CPU 41 executes the displaying process (see FIG. 7). As shown in FIG. 7, when it is determined that the home screen 31 is displayed on the display 7B (S43: YES), the CPU 41 determines whether the tape printing process or the tube printing process is being suspended based on the suspend flag (S45). For example, as mentioned above, when the tube printing process is being suspended, the suspend flag is set to "two". In this case, the CPU 41 determines that the tube printing process is suspended (S45: YES), and forwards the process to S47.

Figure 17:
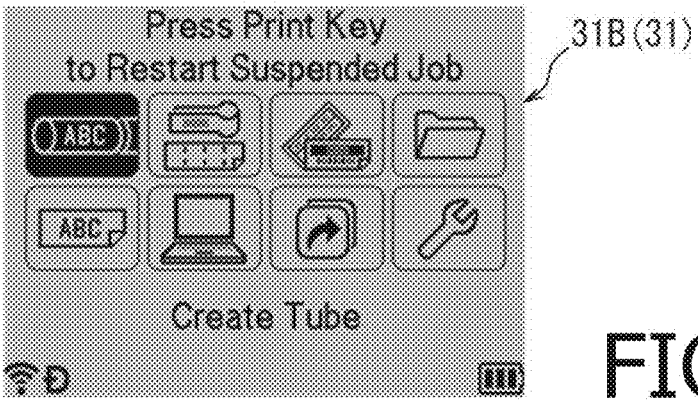
FIG. 17 shows the home screen according the illustrative embodiment.

In S47, the CPU 41 displays the home screen 31B (see FIG. 17), which is composed such that a letter string "Press Print Key to Restart Suspended Job" is additionally displayed onto the home screen 31A on the display 7B. In the following description, the letter string as above, which is additionally displayed on the home screen 31, will be referred to as a "method notifying letter string". The method notifying letter string indicates an operation method to resume the tube printing process which is currently suspended. Specifically, the method notifying letter string indicates that the tube printing process, which is currently suspended, can be resumed by depression of the print key. Thereafter, the CPU 41 terminates the displaying process, and returns the process to the main process (see FIG. 6).

When, in the displaying process, the tape printing process is in the suspended state, the suspend flag is set to "one". In such a case, the CPU 41 determines that the tape printing process is currently suspended (S45: YES). Also in this case, the CPU 41 add the same letter string as is used in a case where the tube printing process is suspended to the home screen 31 and display (S47). That is, the method notifying letter string in this case indicates that the tape printing process, which is currently suspended, can be resumed by depression of the print key.

Here, an example will be shown in which, it is assumed that the home screen 31 added with the method notifying letter string is displayed when the tube printing process or the tape printing process is suspended, and the print key has been depressed in accordance with the method notifying letter string (S17: YES, S19: YES, S23: NO, S27: NO, S31: YES). In this case, in order to resume the tube printing process or the tape printing process, which is currently suspended, the CPU 41 executes the resuming process (see FIG. 11) in S33.

Figure 11:
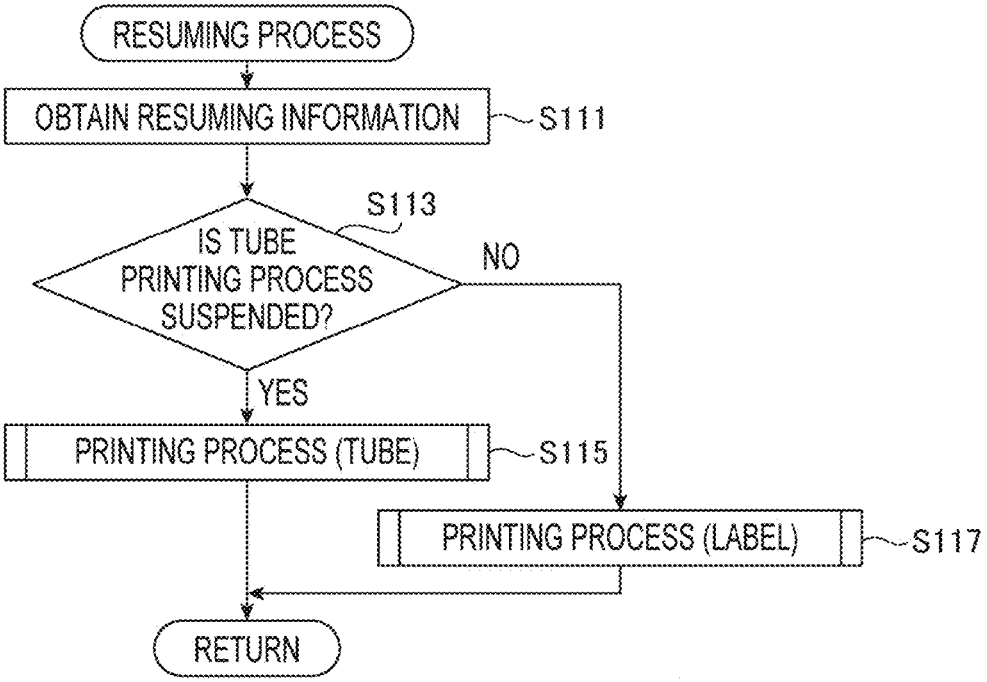
FIG. 11 is a flowchart illustrating a resuming process according to the illustrative embodiment.

Referring to FIG. 11, the resuming process will be described. The CPU 41 obtains, in S111, the resume information which was stored in the flash memory 45 in S95 (see FIG. 10). Then, the CPU 41 determines which of the printing process is suspended based on the suspend flag (S113). That is, when the suspend flag is set to "two", the CPU 41 determines that the tube printing process is currently suspended (S113: YES). In this case, in order to indicate that the suspended state is released, the CPU 41 sets "zero" to the suspend flag and forwards the process to S115. Then, the CPU 41 executes the printing process (see FIG. 10) to resume the tube printing process (S115). After completion of the printing process, the CPU 41 returns the process to the main process (see FIG. 6).

When the suspend flag is set to "one", the CPU 41 determines that the tape printing process is suspended (S113: NO). In this case, the CPU 41 sets "zero" to the suspend flag in order to indicate that the suspended state of the tape printing process is released, and forwards the process to S117. In S117, in order to resume the tape printing process, the CPU 41 executes the printing process (see FIG. 10). After completion of the printing process, the CPU 41 returns the process to the main process (see FIG. 6).

As shown in FIG. 10, in the printing process which is started in the resuming process, the tube printing process or the tape printing process is resumed based on the character for one page, and the remaining number of pages to be printed which are included in the resume information obtained in S111 (see FIG. 11). Specifically, the CPU 41 updates the obtained remaining number of pages every time printing of one page is completed, and determines whether there are remaining pages which is to be printed (S83). When there remain pages which have not been printed yet (S83: YES), the CPU 41 executes the repetitive printing of the character for one page on the tube 9 or the tape 8 (S85). When it is determined that there remain no pages to be printed (S83: NO, S91: NO), or when it is determined that the stop key is depressed in a state where printing of the remaining pages has not been completed (S87: YES, S91: YES, S93: NO), the CPU 41 executes S101 and then, after execution of S97, S99 and S101, the CPU 41 terminates the printing process.

Another example will be described. In this example, one of the tube printing process and the tape printing process is suspended, and the home screen is displayed with the method notifying letter string being additionally displayed thereon, and the print key according to the method notifying letter string will not be depressed, while another key is depressed in that state (S17: YES, S19: NO). In this case, the CPU 41 executes the key depression process (see FIG. 9) in S21.

As shown in FIG. 9, the CPU 41 determines whether one of the tape printing process and the tube printing process is suspended or not based on the suspend flag (S61). When the suspend flag is set to "one", the CPU 41 determines that the tape printing process is being suspended (S61: YES). When the suspend flag is set to "two", the CPU 41 determines that the tube printing process is being suspended (S61: YES). Thereafter, the CPU 41 forwards the process to S63.

In S63, the CPU 41 determines whether a forbidden operation is performed. For example, when the tape printing process is suspended, the forbidden operation is any operation other than one to display the tube edit screen 32 (see FIG. 13) on the display 7B. If the tube printing process is suspended, the forbidden operation is any operation other than one to display the tape edit screen 33 (see FIG. 14) on the display 7B. That is, the forbidden operation when one of the tape and tube printing operations is suspended is an operation other than one to edit the character to be printed in the other one of the tape and tube printing operations.

For example, when the tube printing process is suspended, and the determination key is depressed with the home screen 31B (see FIG. 17) on which the icon C1 for displaying the tube edit screen 32 is inversely displayed, the CPU 41 determines that the forbidden operation has performed (S63: YES).

Figure 18:
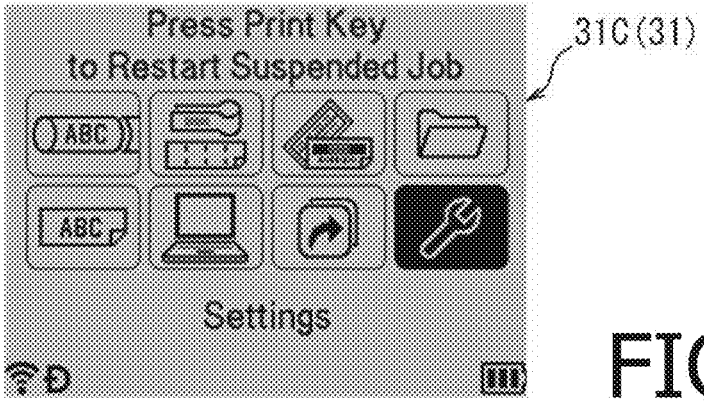
FIG. 18 shows the home screen according the illustrative embodiment.

For example, when the tube printing process is suspended, and the determination key is depressed with the home screen 31C (see FIG. 18) on which the icon C4 for displaying the setting screen is inversely displayed, the CPU 41 determines that the forbidden operation has performed (S63: YES).

The reason why the above-mentioned operations are determined to be the forbidden operations is that the mentioned operations are not operations to edit the character to be printed in the tape printing process when the tube printing process is suspended.

Figure 19:
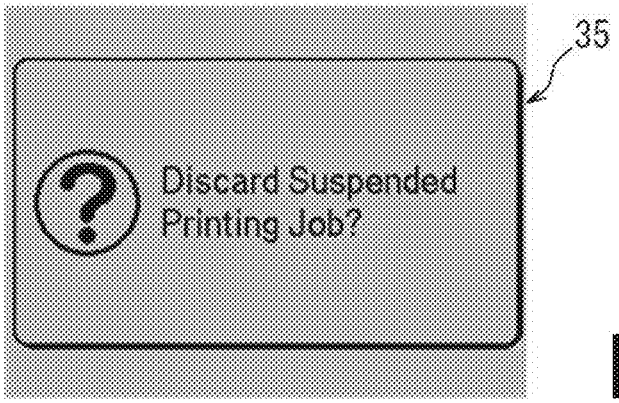
FIG. 19 shows a confirmation screen according the illustrative embodiment.

When the forbidden operation is performed, the CPU 41 displays the confirmation screen 35 (see FIG. 19) on which a letter string "Discard Suspended Printing Job" is indicated (S65). In the following description, the letter string included in the confirmation screen 35 will be referred to as a "warning letter string". The warning letter string notifies that the resume information regarding the suspended printing process will be deleted.

In S67, the CPU 41 determines whether the forbidden operation is performed again when the confirmation screen 35 is displayed. When it is determined that the forbidden operation is performed again (S67: YES), the CPU 41 deletes, in S69, the resume information which is stored in the flash memory 45 in S95 (see FIG. 10). Thereafter, the CPU 41 forwards the process to S71. The CPU 41 executes a process corresponding to the forbidden operation (S71), and set "one" to the display flag (S71) in order to return the screen displayed on the display 7B to the home screen 31. Thereafter, the CPU 41 terminates the key depression process, and returns the process to the main process (see FIG. 6).

Figure 20:
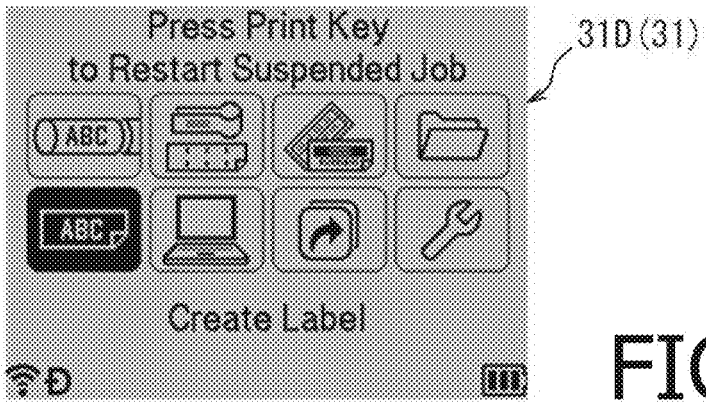
FIG. 20 shows the home screen according the illustrative embodiment.

For example, when the tube printing process is suspended, and the determination key is depressed with the home screen 31D (see FIG. 20) on which the icon C2 for displaying the tape edit screen 33 is inversely displayed, the CPU 41 determines that the forbidden operation has not been performed (S63: NO). The reason why the above-mentioned operation is determined not to be the forbidden operation is that the mentioned operation is an operation to edit the character to be printed in the tape printing process when the tube printing process is suspended.

When it is determined that the forbidden operation has not been performed (S63: NO), the CPU 41 executes a process corresponding to the depressed key (S71). Specifically, when the tube printing process is suspended, the performed operation should be an operation to display the tape edit screen 33 (see FIG. 14), and the CPU 41 displays the tape edit screen 33 on the display 7B (S71). The CPU 41 sets "three" representing that the tape edit screen 33 is displayed on the display 7B to the display flag (S71). In this case, when the displaying process (see FIG. 7) of the main process (see FIG. 6) is executed after completion of the key depression process (see FIG. 9), the CPU 41 continuously displays the tube edit screen 32 based on the display flag which is set to "three" (S41).

When the character keys of the multiple keys 7A are operated to input a string "123456" with the tape edit screen 33 being displayed on the display 7B (S17: YES, S19: NO, S61: NO), the CPU 41 displays the character corresponding to the input character on the tape edit screen 33 (S71).

When the tape printing process is suspended, the operation is to display the tube edit screen 32 (see FIG. 13), the CPU 41 displays the tube edit screen 32 on the display 7B (S71).

As shown in FIG. 6, when it is determined that the print key is depressed in a state where the tube edit screen 32 or the tape edit screen 33 is displayed on the display 7B (S19: YES), the CPU 41 executes the printing process (see FIG. 10) (S25, S29). In the next example, a case where the tape edit screen 33 is displayed and a character is input when the tube printing process is suspended, thereafter, the print key is depressed (S27: YES, S29). In this case, as the printing process (see FIG. 10) is executed, the tape printing process is executed instead of the tube printing process which is being suspended. In this case, the tape printing screen 34B (see FIG. 16) is displayed on the display 7B (S81).

The CPU 41 identifies the font and size based on the general setting information stored in the flash memory 45. Then, based on the repetition setting information stored in the flash memory 45, the CPU 41 identifies the total number of pages and the cutting method. When it is determined that there remain pages which have not been printed (S83: YES), the CPU 41 starts the tape printing process to print the character for one page displayed on the tape edit screen 33 with the identified font and size on the tube 9 (S85). Until it is determined that there remains no pages which have not been printed (S83: NO, S91: NO), the CPU 41 continues the tape printing process.

When it is determined that the stop key is depressed during execution of the tape printing process (S87: YES), since the tube printing process is suspended, value "two" is set to the suspend flag (S93: YES). Therefore, the tape printing process is not suspended.

Next, a case where the power button is depressed in the process of executing the main process (see FIG. 6) will be described. In this case, the CPU 41 determines, in the inspecting process (see FIG. 8), that the power button is depressed (S51: YES). In this case, when the resume information is stored in the flash memory 45, the CPU 41 deletes the resume information (S53). The CPU 41 forwards the process to S57.

Effects of Illustrative Embodiment

As described above, the CPU 41 of the printer 1 is capable of executing the printing operation on the printing medium (i.e., the tape 8 and the tube 9) with the tape printing mechanism 50 and the tube printing mechanism 60. When the stop key of the keyboard 7 is depressed during execution of the tube printing process with use of the tube printing mechanism 60 (S87: YES), the CPU 41 suspends the tube printing process (S97). In this case, the CPU 41 prints the character which is printed when the stop key is depressed to the end of the page, and suspends the printing (S97). It is noted that a case where the stop key is depressed during execution of the tape printing process with the tape printing mechanism 50, control proceeds similarly and correspondingly. Therefore, when the tube printing process or the tape printing process is resumed (S115, S117), the CPU 41 can prevent a condition that a page is divided to portions on which printing is executed before depression of the stop key and after the printing process is resumed.

When the print key is depressed (S27: YES) with the tape edit screen 33 being displayed on the display 7B after suspension of the tube printing process (S97), the CPU 41 executes the tape printing process (S29) instead of the tube printing process which is being suspended. When the print key is depressed (S23: YES) with the tube edit screen 32 being displayed on the display 7B after the tape printing process is suspended (S97), the tube printing process is executed (S25) instead of the tape printing process which is being suspended. According to the above configuration, the CPU 41 executes, instead of one of the printing processes, the other of the printing process with priority.

After the printing process is suspended (S97), the CPU 41 conveys the printing medium (e.g., the tape 8 or the tube 9) until the cutout position on the upstream side with respect to one page of the character-printed portion which was printed immediately before suspension of the printing process coincides with the position of the cutter 57 or 64. Thereafter, the CPU 41 applies full-cut to the printing medium at the cutout position with the cutter 57 or 64 (S99), thereby the CPU 41 cutting out the printed portion. In this case, the CPU 41 can suppress a situation that the printing medium, on which printing of the character for one page has been completed, remains in the printer after the printing process is suppressed.

After the printing process is suspended, there could be a case where multiple character-printed pages, which were printed before the suspension of the printing process remain between the print head 51 and the cutter 57 (in the case of the tape printing process) or between the print head 61 and the cutter 64 (in the case of the tube printing process). In such a case, the CPU 41 conveys the printing medium and cut (i.e., full-cut or half-cut) the same at a timing when each of the boundaries between the adjacent pages of the remained portion is located at the position of the cutter 57 or 64 with use of the cutter 57 or 64 (S99). Thus, even if the printer 1 is once stopped, and printed portions which have not been cut remain the printer 1, the CPU 41 can discharge the remained portions with cutting the same on the page basis.

After the tube printing process is suspended (S97), the CPU 41 receives an input operation of a condition necessary to execute the tape printing process instead of the tube printing process (S63: NO). It is noted that an operation to display the tape edit screen 33 on which the character to be printed in the tape printing process can be edited corresponds to such an input operation. When the print key is depressed with the tape edit screen 33 being displayed, the CPU 41 executes the tape printing process to print the character input through the tape edit screen 33 to the tape 8 instead of the tube printing process which is suspended (S29). In this case, the user can input the character printed in the tape printing process which is executed instead of the tube printing process under the state where the tube printing process is suspended.

In contrast, after the tube printing process is suspended (S97), the CPU 41 does not receive an input operation to input a condition necessary to execute the tube printing process as the forbidden operation (S63: YES). It is noted that an operation to display the tube edit screen 32 on which the character which can be printed in the tube printing process is edited corresponds to such a forbidden operation. According to such a configuration, the CPU 41 can suppress a situation that the character to be printed in the tube printing process is modified during suspension of the tube printing process.

When stop key is depressed (S87: YES) during execution of the printing process, the CPU 41 stores the resume information in the flash memory 45 (S95). With this configuration, the CPU 41 can appropriately resume the printing process, which is suspended in response to depression of the stop key, based on the resume information.

If the print condition is modified during suspension of the printing process, and the printing process is resumed based on the resume information, printing modes may be different before and after the suspension. In such a case, printing quality is deteriorated as white line and the like may occur due to difference of the printing modes.

According to the illustrative embodiment, the CPU 41 displays the confirmation screen 35 including the warning letter string on the display 7B (S65) when the forbidden operation is performed during suspension of the printing process (S63: YES). When the forbidden operation is performed again with the confirmation screen 35 being displayed (S67: YES), the CPU 41 deletes the resume information stored in the flash memory 45 (S69). With this configuration, the CPU 41 can prevent difference of the print modes before and after the suspension of the printing process due to the forbidden operation. Therefore, the CPU 41 can maintain the print quality of the character to be printed in the printing process.

When the printer 1 is powered off during the suspension of the printing process, and the printing process is resumed, after the printer 1 is powered on, based on the resume information, the print modes may be different before and after the suspension of the printing process. For example, when the printing medium is changed while the printer 1 is powered off, the printing process is executed onto different printing media before and after the suspension of the printing process, thereby the printing quality being deteriorated due to different printing modes. According to the illustrative embodiment, when it is determined that the power button was depressed during the suspension (S51: YES), the CPU 41 deletes the resume information stored in the flash memory 45 (S53). With this configuration, the CPU 41 can prevent the print modes from differing before and after the suspension, thereby the print quality being maintained.

When it is detected that none of the multiple keys 7A of the keyboard 7 has been depressed for a particular period (S55: NO), the CPU 41 turn off the power (S57) without deleting the resume information. The reason why the CPU 41 does not delete the resume information in such a case is that such a power off (e.g., auto power off) is a power off the user does not intend, and it is inappropriate to delete the resume information. With this configuration, the CPU 41 can resume the printing process with appropriate condition, with preventing difference of the print modes before and after the suspension of the printing process.

When the home screen 31 is displayed during suspension of the printing process (S45: YES), the CPU 41 displays one of the home screens 31B-31D on which the method notifying letter string is additionally displayed on the display 7B (S47). The method notifying letter string indicates the operation method to resume the printing process being suspended. According to this configuration, the user can easily recognize the operation to resume the printing process which is being suspended.

<Modifications>

The above-described printer is only an example, and can be modified in various ways.

The printing mechanisms provided to the printer 1 need not be limited to the two mechanisms: the tape printing mechanism 50; and the tube printing mechanism 60. The printer 1 may be provided with more than two printing mechanisms.

An operation to suspend the printing process currently executed needs not be limited to depression of the stop key. Further, an operation to execute one printing process while the other printing process is suspended needs not be limited to depression of the print key.

The printer 1 may be connect to an information equipment (e.g., a PC, a smartphone and the like) through a not-shown external interface. When particular information is received from the information equipment through the external interface, the printer 1 may suspend the currently executing printing process. Similarly, when particular information is received from the information equipment through the external interface, the printer 1 may execute, instead of one of the printing processes currently suspended, the other of the printing processes.

According to the illustrative embodiment, after the printing process is suspended (S97), the CPU 41 applies full-cut to the printing medium at the cutout position with use of the cutter 57 or 64 (S99). With this configuration, the CPU 41 cuts out the character-printed portion of the printing medium. In contrast, the CPU 41 may change the cutting method at the cutout position to the full-cut or the half-cut based on the cutting method indicated in the repetition setting information.

After suspending the printing process (S97), the CPU 41 may retain the printing medium as it is, without further conveying the same. In such a configuration, the CPU 41 need not apply the full-cut to the printing medium at the cutout position. Further, the CPU 41 need not cut the printing medium at the boundaries of adjoining pages remaining inside the printer 1.

After the tube printing process is suspended (S97), the receives an operation to display the tape edit screen 33, on which the character to be printed in the tape printing process can be edited (S63: NO), while the other operations are forbidden (S63: YES). In contrast, after the tube printing process is suspended (S97), the CPU 41 may receive an operation to display the setting screen through which a setting condition regarding the tape printing process can be input in addition to the operation to display the tape edit screen 33.

When the print key is depressed in a state where the setting screen, through which the setting condition regarding the tape printing process can be input, is displayed, the CPU 41 may execute the tape printing process in accordance with the input setting condition instead of the tube printing process which is being suspended (S29).

According to the illustrative embodiment, when the forbidden operation is performed during suspension of the printing process (S63: YES), the CPU 41 displays the confirmation screen 35 including the warning letter string on the display 7B (S65). If the forbidden operation is performed again with the confirmation screen 35 being displayed (S67: YES), the CPU 41 deletes the resume information stored in the flash memory 45 (S69), and executes the operation corresponding to the forbidden operation (S71). In contrast, the CPU 41 may only receive an input operation of the condition necessary to execute the printing process. That is, in this case, the CPU 41 does not display the confirmation screen 35, and need not execute a process corresponding to the forbidden operation. Further, in such a case, the resume information may be retained in the flash memory 45.

According to the illustrative embodiment, when it is determined that the power button is depressed (S51: YES), the CPU 41 deletes the resume information stored in the flash memory 45 (S53). In contrast, the CPU 41 may be configured to delete the resume information stored in the flash memory 45 when a particular operation (e.g., a long-press of the power button), which is different from an ordinary power-off operation, is performed.

According to the illustrative embodiment, when it is determined that a state where none of the multiple keys 7A of the keyboard 7 has been depressed for a particular period (S55: NO), the CPU 41 powers off the printer 1 without deleting the resume information (S57). In contrast, the CPU 41 may be configured to delete the resume information even if it is determined that a state where none of the multiple keys 7A of the keyboard 7 has been depressed for a particular period. Alternatively, the printer 1 may be configured such that whether the resume information is deleted or not when it is determined that a state where none of the multiple keys 7A of the keyboard 7 has been depressed for a particular period can be switched by a user setting.

According to the illustrative embodiment, when the home screen 31 is displayed when the printing process is suspended (S45: YES), the CPU 41 displays one of the home screens 31B-31D on which the method notifying letter string is additionally indicated on the display 7B (S47). In contract, the CPU 41 may be configured to output audio guidance indicating the operation method to resume the printing process which is suspended through a not-shown speaker.

In the above-described embodiment, the cutter 57 may be configured to apply at least one of the full-cut and the half-cut with respect to the tape 8. Similarly, the cutter 64 may be configured to apply at least one of the full-cut and the half-cut with respect to the tube 9.

What is claimed is:

1. A printer having multiple printing mechanisms including a first printing mechanism and a second printing mechanism each configured to apply printing to a printing medium, the printer comprising:

a printing device configured to execute a printing process to repetitively print a character defined for a page with one of the multiple printing mechanisms, the printing process including a first printing process and a second printing process, the first printing process being a process for printing a plurality of pages of the character of a first printing medium using the first printing mechanism, the second printing process being a process for printing on a second printing medium, physically separate and distinct from the first printing medium, using the second printing mechanism; and a controller, the controller being configured to:

determine whether a first instruction to suspend the printing process in execution is received;

when it is determined that the first instruction is received while the printing device is executing the first printing process:

complete printing of a page which is being printed when the first instruction is received, and suspend the first printing process thereafter but before completion of the first printing process;

determine whether a second instruction to start the second printing process using the second printing mechanism is received after the first printing process is suspended; and execute the second printing process when it is determined that the second instruction is received and while the first printing medium remains in a printing position with respect to the first printing mechanism; and when it is determined that the first instruction is received while the printing device is executing the second printing process and while the first printing medium remains in the printing position with respect to the first printing mechanism, continue to execute the second printing process.

2. The printer according to claim 1, further comprising a cutting mechanism arranged on a downstream side with respect to the first printing mechanism in a conveying direction of the first printing medium, and configured to apply full-cut to the first printing medium, wherein the controller is further configured to apply the full-cut with the cutting mechanism to an upstream side of a printed portion having the character for one page of the first printing medium, to cutout the printed portion after the controller suspended the first printing process, wherein the printed portion was printed immediately before the first printing process was suspended.

3. The printer according to claim 2, wherein the cutting mechanism is configured to apply at least one of the full-cut and a half-cut to the first printing medium; and wherein one of the full-cut and the half-cut is applied to each boundary between multiple pages, on which the character was printed, of the first printing medium before the first printing process was suspended by the controller, after suspension of the first printing process.

4. The printer according to claim 1, wherein the controller is further configured:

not to receive a first printing condition when the first printing process is executed after the first printing process was suspended and before it is determined that the second instruction was received; and to receive a second printing condition when the second printing process is executed, wherein the controller is configured to execute the second printing process using the second printing mechanism based on the second printing condition as received when it is determined that the second instruction was received.

5. The printer according to claim 1, further comprising a storage configured to store resume information which is necessary to resume the first printing process when it is determined that the first instruction was received, wherein the controller is configured to resume the first printing process based on the resume information after the controller suspends the first printing process.

6. The printer according to claim 5, wherein the controller is further configured to:

determine whether a third instruction was received after it is determined that the first instruction was received and before it is determined that the second instruction is received; and delete the resume information stored in the storage when it is determined that the third instruction was received.

7. The printer according to claim 5, wherein the controller is further configured to:

determine whether an off instruction to power off the printer is received; and delete the resume information stored in the storage when it is determined that the off instruction is received.

8. The printer according to claim 7, wherein the controller is further configured to:

determine whether a first off instruction is received when a particular operation of an operation section is performed, and a second off instruction is received when no operation of the operation section has been performed for a particular period;

delete the resume information only when it is determined that the first off instruction is received, but not delete the resume information when it is determined that the second off instruction is received.

9. The printer according to claim 5, the controller is further configured to:

display a particular screen on a display after the first printing process is suspended; and resume the first printing process based on the resume information when a particular operation is performed with the particular screen being displayed on the display.

10. The printer according to claim 9, the controller is further configured to display information indicating a method of the particular operation after the first printing process is suspended.

11. A printer having multiple printing mechanisms including a first printing mechanism and a second printing mechanism each configured to apply printing to a printing medium, the printer comprising:

a printing device configured to execute a printing process to repetitively print a character defined for a page with one of the multiple printing mechanisms; and a controller, the controller being configured to:

determine, while the printing device is executing a first printing process which is the printing process for one page using the first printing mechanism, whether a first instruction to suspend the first printing process is received;

when it is determined that the first instruction is received, complete printing of a page which is being printed when the first instruction is received, and suspend the first printing process thereafter;

determine whether a second instruction to start a second printing process using the second printing mechanism is received after the first printing process is suspended; and execute the second printing process using the second printing mechanism when it is determined that the second instruction is received, wherein the controller is further configured:

not to receive a first printing condition when the first printing process is executed after the first printing process was suspended and before it is determined that the second instruction was received; and to receive a second printing condition when the second printing process is executed, wherein the controller is configured to execute the second printing process using the second printing mechanism based on the second printing condition as received when it is determined that the second instruction was received.

12. A printer having multiple printing mechanisms including a first printing mechanism and a second printing mechanism each configured to apply printing to a printing medium, the printer comprising:

a printing device configured to execute a printing process to repetitively print a character defined for a page with one of the multiple printing mechanisms, the printing process including a first printing process and a second printing process, the first printing process being a process for printing on a first printing medium using the first printing mechanism, the second printing process being a process for printing a plurality of pages of the character of a second printing medium, physically separate and distinct from the first printing medium, using the second printing mechanism; and a controller, the controller being configured to:

determine whether a first instruction to suspend the printing process in execution is received;

when it is determined that the first instruction is received while the printing device is executing the first printing process, complete printing of a page which is being printed when the first instruction is received, and suspend the first printing process thereafter but before completion of the first printing process;

determine whether a second instruction to start the second printing process using the second printing mechanism is received after the first printing process is suspended; and execute the second printing process when it is determined that the second instruction is received and while the first printing medium remains in a printing position with respect to the first printing mechanism; and when it is determined that the first instruction is received while the printing device is executing the second printing process and while the first printing medium remains in the printing position with respect to the first printing mechanism, continue to execute the second printing process.

13. The printer according to claim 12, wherein the controller is further configured:

not to receive a first printing condition when the first printing process is executed after the first printing process was suspended and before it is determined that the second instruction was received; and to receive a second printing condition when the second printing process is executed, wherein the controller is configured to execute the second printing process using the second printing mechanism based on the second printing condition as received when it is determined that the second instruction was received.

14. The printer according to claim 12, further comprising a storage configured to store resume information which is necessary to resume the first printing process when it is determined that the first instruction was received, wherein the controller is configured to resume the first printing process based on the resume information after the controller suspends the first printing process.

15. The printer according to claim 14, wherein the controller is further configured to:

determine whether an off instruction to power off the printer is received; and delete the resume information stored in the storage when it is determined that the off instruction is received.

16. The printer according to claim 15, wherein the controller is further configured to:

determine whether a first off instruction is received when a particular operation of an operation section is performed, and a second off instruction is received when no operation of the operation section has been performed for a particular period;

delete the resume information only when it is determined that the first off instruction is received, but not delete the resume information when it is determined that the second off instruction is received.

* * * * *